US005855361A

United States Patent [19]

Krowchak

[11] Patent Number: 5,855,361

[45] Date of Patent: Jan. 5, 1999

[54] TAIL STOCK FOR A CARPET STRETCHER

[76] Inventor: Michael A. Krowchak, 2751 Slater Ave., NW., East Canton, Ohio 44730

[21] Appl. No.: 811,265

[22] Filed: Mar. 4, 1997

[51] Int. Cl.[6] ..... B25B 1/00

[52] U.S. Cl. ..... 254/209

[58] Field of Search ..... 254/209, 210, 254/211, 212, 201, 204, 205, 206, 207

[56] References Cited

U.S. PATENT DOCUMENTS

| | | | |
|---|---|---|---|
| 2,606,743 | 8/1952 | Owens | 254/212 |
| 3,706,440 | 12/1972 | Ross . | |
| 3,752,440 | 8/1973 | Ream . | |
| 4,538,846 | 9/1985 | Alexander . | |
| 4,730,858 | 3/1988 | Humann | 254/209 |
| 4,828,305 | 5/1989 | Gaddy . | |
| 5,007,616 | 4/1991 | Scarpino | 254/212 |

*Primary Examiner*—Katherine Matecki
*Attorney, Agent, or Firm*—Sand & Sebolt

[57] ABSTRACT

A tail stock for a carpet stretcher includes a generally V-shaped body with a pair of intersecting abutting surfaces which form a V-shaped recess with an included angle therebetween. The tail stock is adapted to engage a flat wall, intersecting corner wall surfaces, a center post and includes a floor hook attachment to directly engage the floor. A pair of end sections having front coplanar surfaces extend outwardly from non-intersecting ends of the V-shaped section. A layer of resilient material is disposed on the co-planar and abutting surfaces and includes a plurality of spaced parallel vertically extending ribs. A pair of spaced flanges extend rearwardly from a top and a bottom of the tail stock forming a recessed area therebetween. A pair of aligned holes are formed in the top and bottom flanges for pivotally mounting a tubular end of a carpet stretcher to the tail stock. A second set of aligned holes are formed in the top and bottom flanges for receiving a stabilizing pin which restricts the pivotal movement of the tubular member with respect to the tail stock. A pair of wheels are rotatably mounted on a bottom of the tail stock to allow the tail stock to be selectively moved along the wall or around a center post or corner. The floor hook attachment is removably secured within the V-shaped recess and includes an outwardly extending claw having a downwardly extending pointed end for directly engaging the carpet and floor board thereunder.

20 Claims, 7 Drawing Sheets

TAIL STOCK FOR A CARPET STRETCHER

BACKGROUND OF THE INVENTION

1. Technical Field

Generally, the invention relates to a tail stock for a carpet stretcher. Particularly, the invention relates to a tail stock for a carpet stretcher which can be used to stretch carpet against a flat wall, intersecting corner wall surfaces or a center room post and which includes a floor hook attachment which hooks into the floor to anchor the carpet stretcher in a large room free of posts. Specifically, the invention relates to a tail stock which has a pair of vertically extending co-planar surfaces for abutting the flat wall, a V-shaped section formed between the two planar surfaces for engaging the intersecting corner wall surfaces and center room post, and a floor hook attachment which has a downwardly extending hooked first end and a second end complementary in shape to the V-shaped section of the tail stock wherein the second end extends within the recess when the floor hook attachment is attached to the tail stock.

2. Background Information

When a carpet installer installs wall-to-wall carpet in a room, tacking boards, commonly known as tackless stripping, are secured around the floor adjacent each peripheral wall. The installer places the carpet over the tacking boards of one side of the room and secures the carpet thereto. The installer then uses a carpet stretcher to stretch the other sides of the carpet to their respective tacking boards for securing thereto.

Conventional carpet stretchers include a tail stock located at one end of the tool and a carpet-engaging head on the other end of the tool. The tail stock has a flat end which is placed against the wall of the first side of the room and the carpet-engaging head has pins or studs which engage the carpet. Telescopic tubing or pipe sections are used to move the carpet-engaging head into position across the room. A toggle-type mechanism near the portion of the telescopic tubing is used to move the carpet-engaging head away from the tail stock after the pins of the head have engaged the carpet. The installer stretches the carpet until it extends over the tacking boards of the remaining sides of the room and is secured thereto.

One problem with these conventional carpet stretchers is that the tail stocks have a flat surface to abut straight walls when the carpet stretcher is being used to install carpet. Many rooms in modern homes have L-shaped rooms formed by two outwardly projection wall surfaces which meet at a right angle forming a corner therebetween. The flat surface of the tail stock does not conform to the outwardly extending corner making it difficult for the installer to stretch the carpet to the corner opposite the projecting walls. The tail stock is placed against one of the projecting walls and the carpet stretcher extends toward the opposite corner at an acute angle to the wall. When the carpet installer applies pressure against the wall during installation of the carpet, the tail stock slides laterally along the wall preventing the installer from applying the pressure needed to stretch the carpet.

One method used by carpet installers to compensate for this problem is to have a workman's foot placed against the tail stock to prevent the tail stock from sliding. However, this method was found to be ineffective because of the workman's inability to counteract the magnitude of the force exerted on the tail stock.

Several prior art devices were developed which address the problem of installing carpet in an L-shaped room. For example, U.S. Pat. No. 3,706,440 discloses a tail block which has a V-shaped section formed between a pair of flat sections. The flat sections allow the tail stock to be used against a flat wall and the recess receives the outwardly extending corner and allows the tail stock to be used against the corner.

U.S. Pat. No. 3,752,440 discloses a carpet stretching pivot bridge which includes a pair of outwardly extending legs pivotally secured to the tail stock. One of the legs includes a flat end for contacting a flat wall and the other leg includes an L-shaped end which engages the outwardly extending corner.

Another problem with the conventional carpet stretchers is that they are not long enough to extend between opposing walls in a large room, or in a large room with a support post, the flat surface of the tail stock is not adapted to engage the cylindrical shaped support post.

One prior art device which addresses the problem of installing carpet in a large room with support posts is disclosed in U.S. Pat. No. 4,538,846 which includes a plurality of brace assemblies which are connected in place of the tail stock. The brace assemblies are generally U-shaped and are adapted to fit around and grasp the support posts allowing the carpet-engaging head to stretch the carpet in a direction away from the support post.

Another device includes a floor hook which attaches to the end of the telescopic tubing and includes an elongated downward extending pointed hook which extends into and anchors the telescopic end to the carpet to allow the carpet-engaging head to stretch the carpet to the walls of the large room free of center room posts.

Although these devices were adequate for the purpose for which they were intended, all of the different attachments and tail stock ends are needed to install carpet in certain buildings. The carpet installers must carry all of the different attachments to and from the worksite which is burdensome and time consuming. The carpet installers must make multiple trips to their vehicles to transport the heavy carpet stretcher and attachments into the room to be carpeted.

Also, the carpet installer often desires to rigidly mount the tail stock to the carpet-engaging head and prevent any pivotal movement thereof. These prior art tail stocks fail to disclose a tail stock which can be either rigidly or pivotally mounted without modification thereto. U.S. Pat. No. 3,706,440 described above requires a special attachment at the end of the telescopic tubing which allows the carpet-engaging head to pivotally mount on the tail stock.

Further, it is desirable for the tail stock to have wheels to allow the carpet installer to easily move the tail stock along the wall without having to walk back and forth between the tail stock and carpet-engaging head each time the carpet installer secures a portion of the carpet to the tacking boards.

Additionally, the tail stock must include a tacky outer surface to allow the carpet installer to selectively hold the tail stock against the flat wall, intersecting corner wall surfaces or center room post.

Therefore, the need exists for an improved tail stock for a carpet stretcher which reduces the number of attachments to be carried to and from the worksite, which includes a tail stock capable of engaging a straight wall, intersecting corner wall surfaces or a support post, and which includes one floor hook attachment which is easily attached to the tail stock to allow the tail stock to engage the floor of a large room free of support posts.

SUMMARY OF THE INVENTION

Objectives of the invention include providing a tail stock for a carpet stretcher which is capable of engaging a flat wall, intersecting corner wall surfaces or a vertical support post which extends between the ceiling and the floor of a large room.

Another objective is to provide such a tail stock which includes a floor hook attachment which is easily attached to the tail stock and which includes a downwardly extending pointed hook which engages the carpet and anchors the tail stock to the floor to allow the carpet stretcher to stretch the carpet between distant walls.

Yet another objective is to provide such a tail stock which mounts directly to the end of the telescopic tubing of the carpet-engaging head.

A further objective is to provide such a tail stock which can either pivotally or rigidly connect to the carpet-engaging head.

A still further objective is to provide such a tail stock which includes wheels which allow the tail stock to be easily moved along the walls and easily transported between the worksite and the work vehicle.

Another objective is to provide such a tail stock in which the outer surface thereof includes a tacky surface to frictionally engage the wall, intersecting corner wall surfaces or support post to prevent sliding or slippage of the tail stock during stretching of the carpet.

These objectives and advantages are obtained by the improved tail stock for a carpet stretcher of the present invention, the general nature of which may be stated as including a body having two intersecting vertically extending abutting surfaces disposed adjacent one another and forming an included angle therebetween, and a pair of co-planar surfaces adjacent a non-intersecting end of each abutting surface; pivot means for pivotally mounting said tail stock to an end of the tubular member, said pivot means providing a pivotal movement of the tail stock relative to the carpet-engaging head; stabilizing means for stabilizing the tail stock in a rigid configuration and preventing the pivotal movement thereof; resilient means formed on the abutting surfaces and the co-planar surfaces for preventing the tail stock from moving during use thereof; and floor hook means attachable to the body for hooking the tail stock on a substantially horizontal planar surface.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
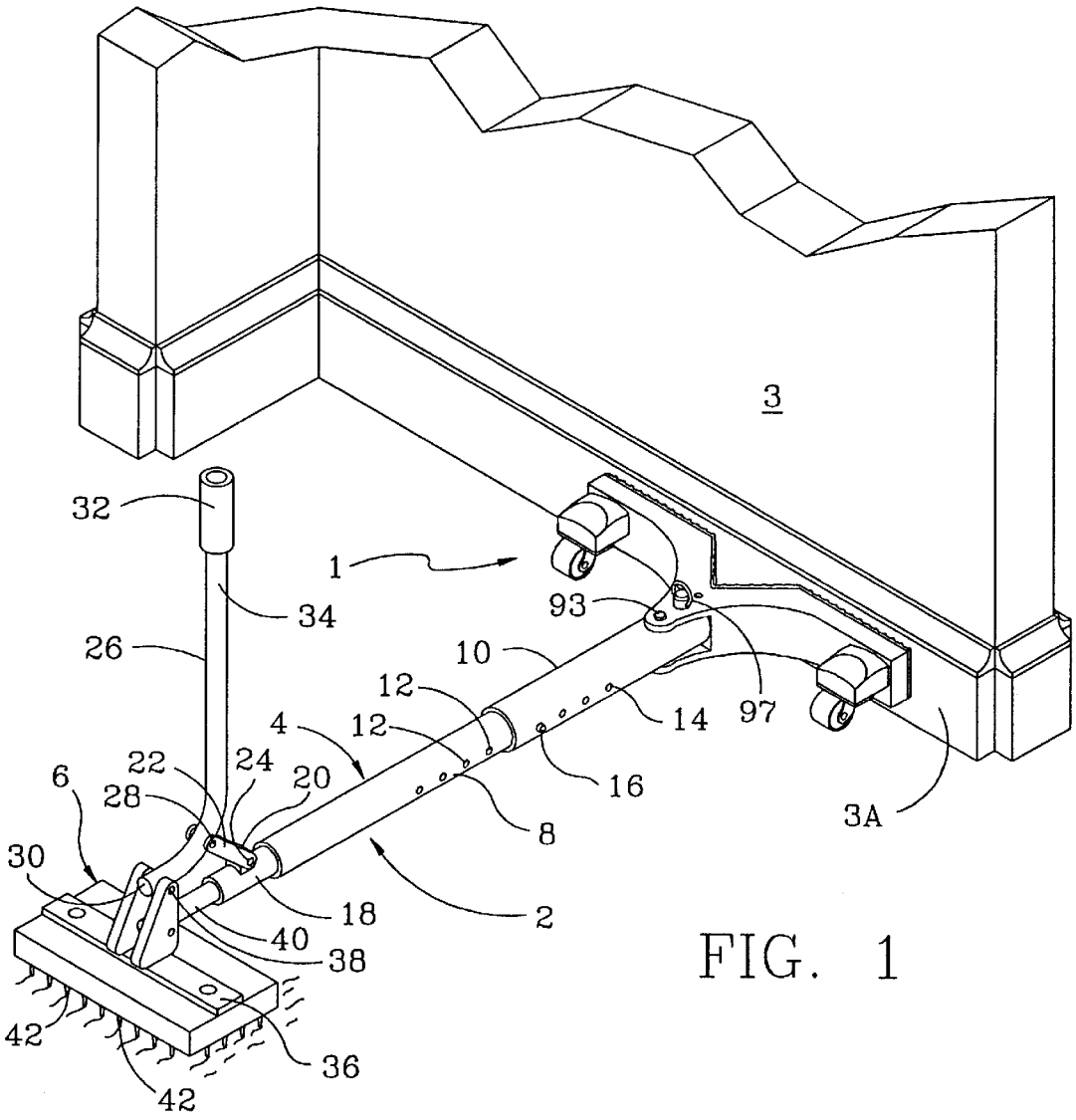
FIG. 1 is a perspective view of the tail stock of the present invention being used with a carpet-engaging head to push against a flat wall.
Figure 2:
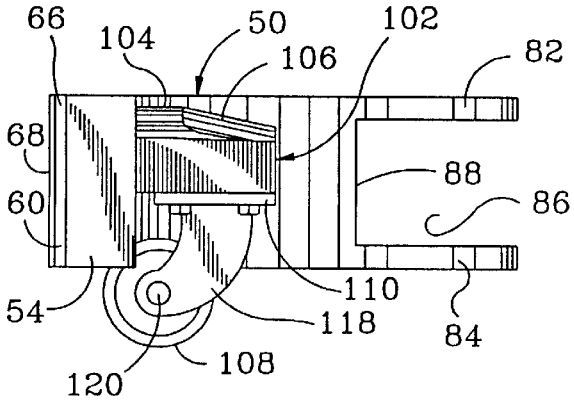
FIG. 2 is a right elevational side view of the tail stock of FIG. 1.
Figure 3:
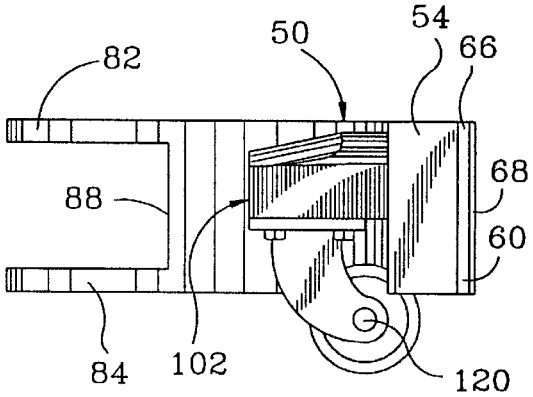
FIG. 3 is a left elevational side view of the tail stock of FIG. 2.

The tail stock of the present invention is indicated generally at 1 in FIG. 1 and is shown in use with a carpet stretcher 2 abutting a vertically extending flat wall 3 and particularly a floor molding 3*a* attached to wall 3. Carpet stretcher 2 generally includes a telescopic tubular member 4 and a carpet-engaging head 6. Tubular member 4 consists of a first telescoping section 8 which is slidably disposed within larger diametered tubular telescoping section 10. Telescoping sections 8 and 10 can be longitudinally adjusted with respect to each other to vary the distance between carpet-engaging head 6 and tail stock 1.

Two rows of diametrically opposed holes 12, one of which is shown in FIG. 1, are formed in telescoping section 8. Similarly, two rows of diametrically opposed holes 14, one of which is shown in FIG. 1, are formed in telescoping section 10. Holes 12 are longitudinally aligned with holes 14 wherein at least one set of holes 12 will coaxially align with one set of holes 14 to receive a connecting pin 16 therethrough. Connecting pin 16 secures tubular member 4 at a desired length and prevents movement of telescoping section 8 within telescoping section 10. Alternatively, telescoping section 8 may be provided with a pair of usual spring-biased detents which snap fits within one set of holes 14 of telescoping section 10 to lock tubular member 4 at the desired length. A pair of adjacent linearly aligned holes (not shown) are formed in the tail stock end of telescoping section 10 of tubular member 4 to attach tubular member 4 to tail stock 1 as described below.

A tubular extension 18 projects from the carpet-engaging end of telescoping section 8 and is rigidly affixed thereto. A flange 20 projects laterally from extension 18. A pair of links 22 are pivotally attached to either side of flange 20 by a pivot pin 24. Links 22 extend from flange 20 to a lever handle 26 and are pivotally attached thereto by another pivot pin 28. Handle 26 is pivotally mounted at a lower end 30 thereof to carpet-engaging head 6, and includes a hand gripping member 32 at an upper end 34 thereof. A mounting plate 36 is secured to the top surface of carpet-engaging head 6 and includes a pair of spaced parallel flanges 38 between which lower end 30 of handle 26 extends to pivotally mount handle 26 to carpet-engaging head 6. A small tubular section 40 has one end secured to mounting plate 36 and has its other end slidably disposed within tubular extension 18.

Carpet-engaging head 6 includes a plurality of nap-gripping fingers or pins 42 rigidly embedded therein. Pins 42 penetrate a tufted pile of a carpet, as well as a looped pile or soft-backed carpet, and firmly engage the napping of the carpet being stretched by carpet stretcher 2.

Figure 4:
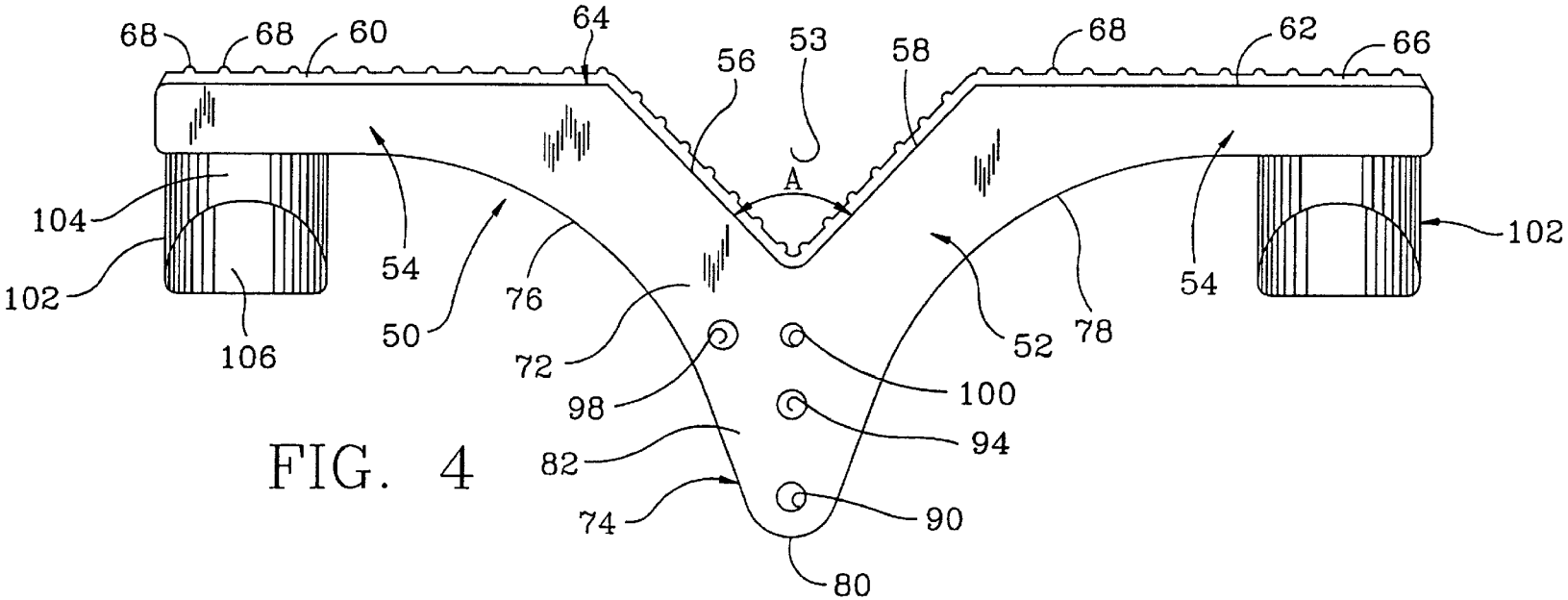
FIG. 4 is a top plan view of the tail stock of FIG. 3.
Figure 5:
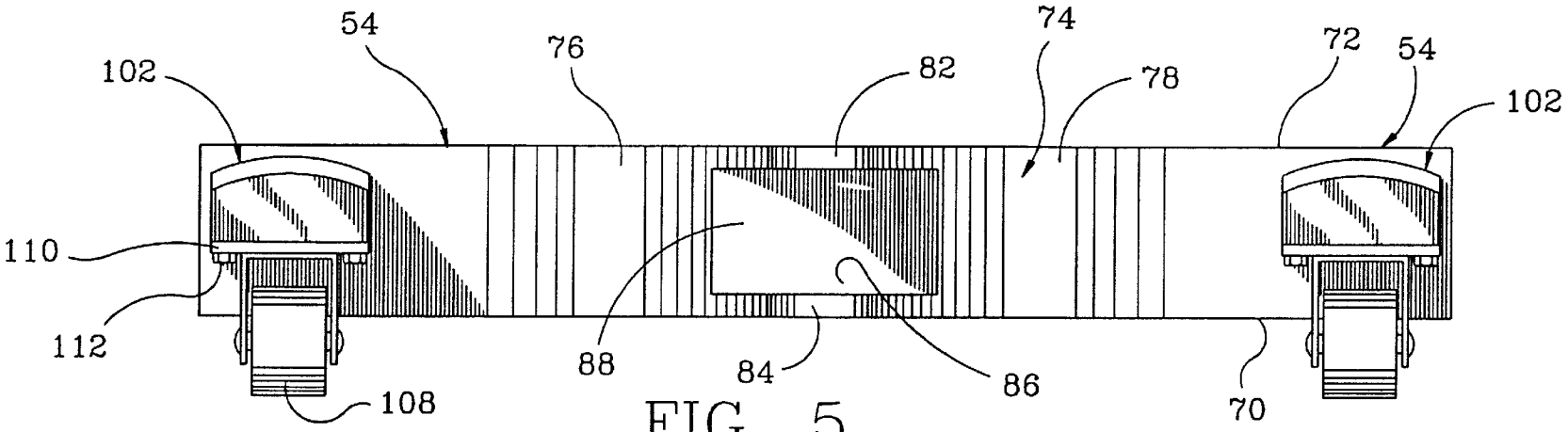
FIG. 5 is a rear elevational view of the tail stock of FIG. 4.
Figure 8:
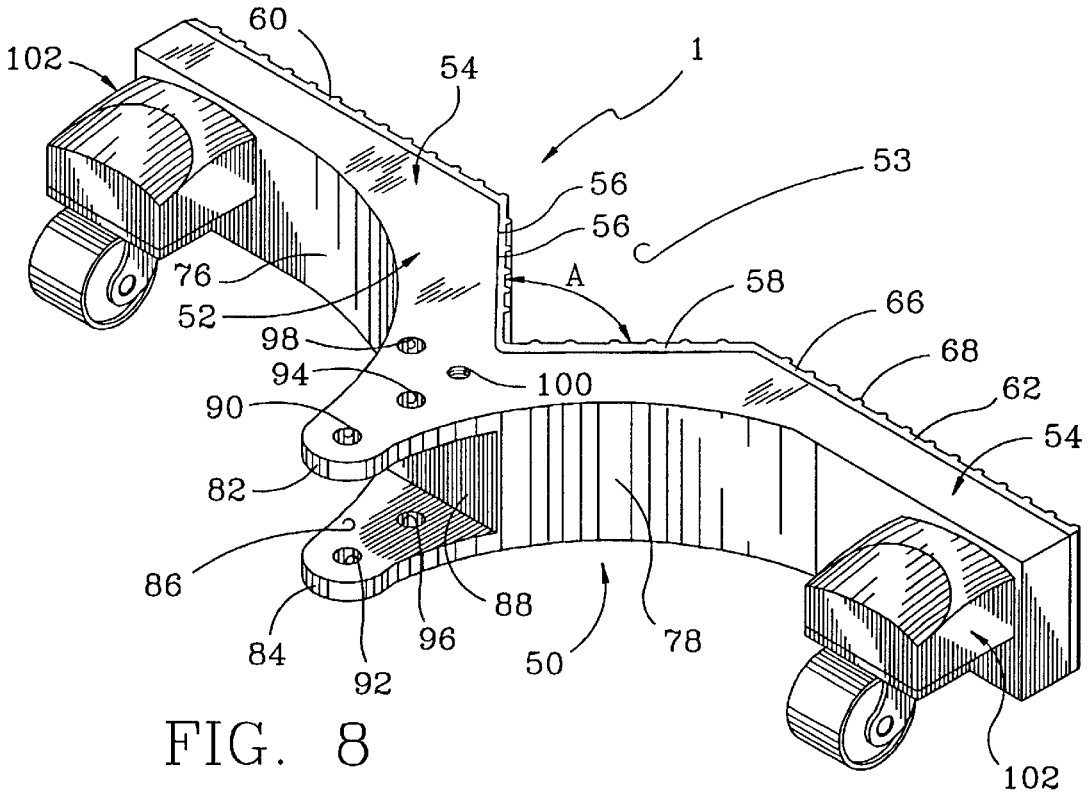
FIG. 8 is a rear perspective view of the tail stock of FIG. 7.
Figure 9:
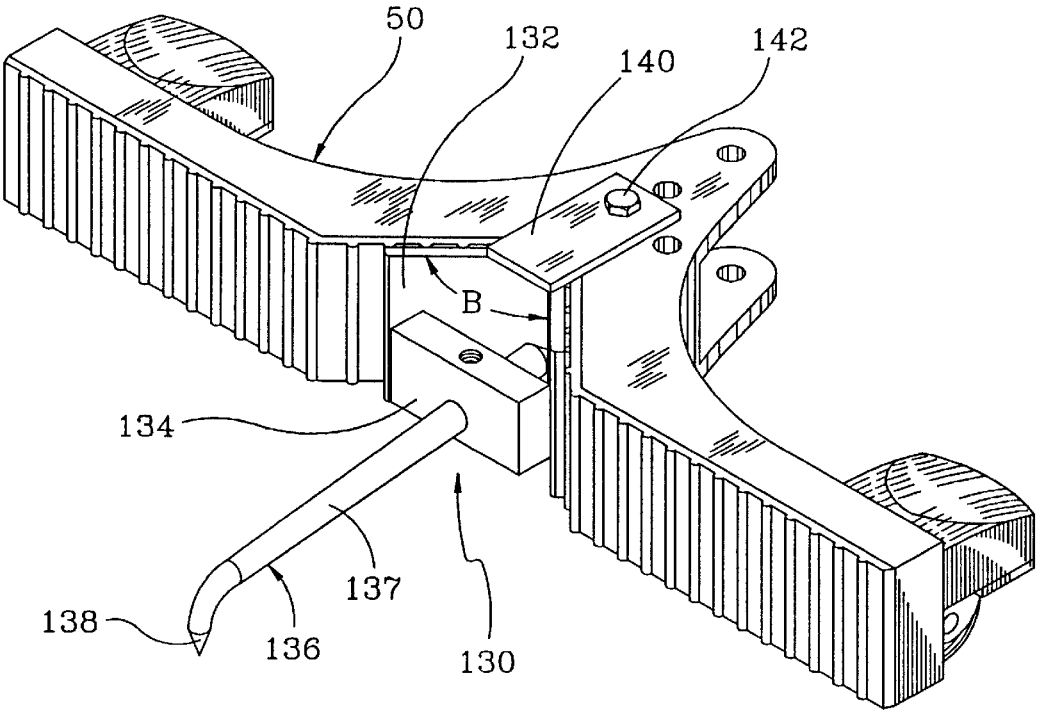
FIG. 9 is a front perspective view of the tail stock of FIG. 8 showing the floor hook attachment attached thereto.

In accordance with one of the features of the invention, and as shown in FIG. 1, tail stock 1 is adapted to be mounted to the tail stock end of telescoping section 10 of tubular member 4. Tail stock 1 includes a body indicated generally at 50 (FIGS. 4 and 7–9) formed of a high strength material, such as steel or aluminum and including a middle section 52 (FIGS. 4 and 8) which is generally V-shaped in plan configuration and which forms a V-shaped recess 53, and two co-planar sections 54 which extend outwardly from each end of V-shaped section 52. V-shaped section 52 includes a pair of vertically extending abutting surfaces 56 and 58 which intersect to form an included angle "A" (FIG. 4) therebetween. In the preferred embodiment, the intersecting point of surfaces 56 and 58 is slightly rounded and forms angle "A" of approximately 90°. Co-planar sections 54 include vertically extending co-planar surfaces 60 and 62 adjacent the non-intersecting ends of abutting surfaces 56 and 58, respectively. Surfaces 56, 58, 60 and 62 face outwardly and form a continuous front surface 64 of body 52.

Figure 6:
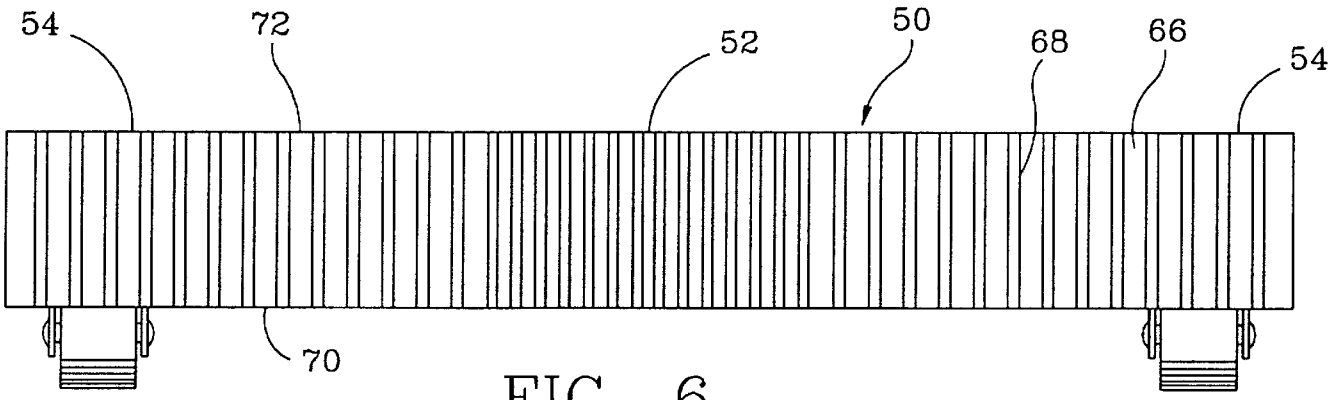
FIG. 6 is front elevational view of the tail stock of FIG. 5.
Figure 7:
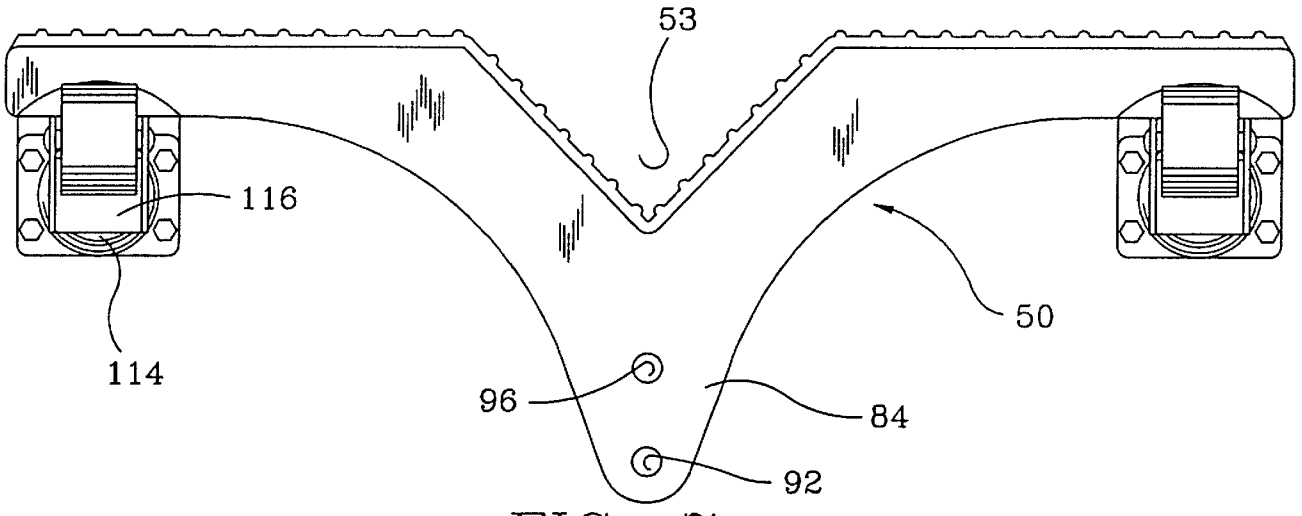
FIG. 7 is a bottom view of the tail stock of FIG. 6.

In accordance with another of the features of the invention, a relatively thin layer 66 of a resilient material, such as rubber, is affixed to front surface 64 of body 50. Layer 66 follows the contour of surfaces 56, 58, 60 and 62 and covers front surface 64 from a bottom 70 to a top 72 (FIG. 6) of body 50. A plurality of spaced parallel vertically extending ribs 68 are formed on the outer surface of layer 66 which allow layer 66 to frictionally engage a surface to be pushed upon by tail stock 1, as described below.

Body 50 has a rear surface 74 having a first arcuate shaped surface 76 opposite co-planar surface 60 and abutting surface 56, a second arcuate shaped surface 78 opposite co-planar surface 62 and abutting surface 58, and a relatively narrow outwardly extending rounded projection 80 which connects adjacent ends of first and second arcuate shaped surfaces 76 and 78, respectively. Projection 80 extends rearwardly opposite included angle "A".

In accordance with another of the features of the invention, a pair of spaced parallel horizontally extending flanges 82 and 84 form the top and bottom, respectively, of rounded projection 80. A recessed area 86 is formed between top and bottom flanges 82 and 84, respectively, and has a flat truncated front wall 88 which is formed between arcuate shaped surfaces 76 and 78. A first pair of holes 90 and 92 are formed in top and bottom flanges 82 and 84, respectively. Holes 90 and 92 axially align with one another to receive a pivot pin 93. Pivot pin 93 pivotally mounts tubular member 4 to tail stock 1 as described below in further detail. A second pair of holes 94 and 96 are formed in top and bottom flanges 82 and 84, respectively, adjacent first holes 90 and 92, respectively. Second holes 94 and 96 also axially align with one another to receive a stabilizing pin 97. Stabilizing pin 97 rigidly secures tubular member 4 to tail stock I (FIG. 10) and prevents the pivotal movement of tail stock 1 relative to tubular member 4. A storage hole 98 is formed in V-shaped section 52 between abutting surface 56 and first arcuate shaped surface 76 for receiving and storing stabilizing pin 97 when pin 97 is not in use. A smaller internally threaded hole 100 is formed in V-shaped section 52 adjacent included angle "A". The center of holes 90, 92, 94, 96 and 100 are all linearly aligned with one another and with the vertex of angle "A".

A pair of wheel housings 102 extend rearwardly from adjacent the outer end of co-planar sections 54 and body 50. Wheel housings 102 are generally block-shaped and have a curved upper surface 104 which has a slightly tapered rear section 106. A usual pair of rotatable wheel casters 107 are mounted on a bottom surface of wheel housings 102 by a thin mounting plate 110 which is held in place by four bolts 112. Rotatable wheel casters 107 each include a wheel 108 which is rotatably mounted to mounting plate 110 by a usual ball bearing assembly 114. Ball bearing assembly 114 includes a wheel mount 116 having a pair of downwardly extending spaced parallel flanges 118 positioned on each side of casters or wheels 108. An axle pin 120 extends between flanges 118 to rotatably mount each wheel 108 to its respective wheel housing 102. Rotatable wheel casters 107 allow tail stock 1 to slide parallel to and along wall 3 as the carpet is stretched and tacked to the floor opposite wall 3, as described below.

In use, tubular member 4 is adjusted to a desired length by sliding telescoping section 8 within telescoping section 10 until at least one set of holes 12 of section 8 aligns with one set of holes 14 of section 10. Connecting pin 16 is inserted through holes 12 and 14 to lock tubular member 4 at the selected length. The tail stock end of tubular member 4 is inserted within recessed area 86 between top and bottom flanges 82 and 84, respectively. Pivot pin 93 is then placed through holes 90 and 92 and the inner hole of the tail stock end of telescoping section 10 to pivotally mount tubular member 4 and carpet engaging head 6 to tail stock 1.

In a first application, co-planar surfaces 60 and 62 of body 50 are placed against flat wall 3 as shown in FIG. 1. Pins 42 of carpet-engaging head 6 engage the carpet that is to be stretched and the carpet installer applies a downward pressure on handle 26. Handle 26 cooperates with links 22 to produce a toggle spreading effect on tubular section 40. Section 40 moves away from tubular extension 18 causing carpet-engaging head 6 to stretch the carpet away from flat wall 3.

Layer 66 of the resilient material and specifically ribs 68 thereof frictionally retain tail stock 1 against floor molding 3*a* and flat wall 3. Ribs 68 provide a gripping surface and prevent co-planar surfaces 60 and 62 from sliding or slipping laterally along wall 3. The alignment of co-planar surfaces 60 and 62 and the symmetric construction of the sides of body 50 provide for an even distribution of pressure between co-planar sections 54.

When carpet stretcher I is used in a generally straight configuration as that shown in FIG. 1, stabilizing pin 97 may be inserted through holes 94 and 96 of top and bottom flanges 82 and 84, respectively, and the outer hole formed in telescoping section 10. Stabilizing pin 97 cooperates with pivot pin 93 to retain tail stock 1 in a rigid configuration relative to tubular member 4 and carpet-engaging head 6, preventing the pivotal movement thereof. V-shaped recess 53 allows tail stock 1 to span a usual phone-jack typically placed along a lower end of flat wall 3 and floor molding 3*a*. Co-planar surfaces 60 and 62 push against the wall on each side of the phone jack while recess 53 protects the phone jack from being damaged during the carpet installation.

As the carpet is stretched away from wall 3, it is tacked down and secured in place. The carpet must be stretched in periodic intervals parallel to wall 3 which requires tail stock 1 to be slid horizontally along and parallel to wall 3. Rotatable wheel casters 107 rotate to allow tail stock 1 to roll along wall 3 as the carpet opposite wall 3 is periodically stretched and tacked by the carpet installer.

Figure 10:
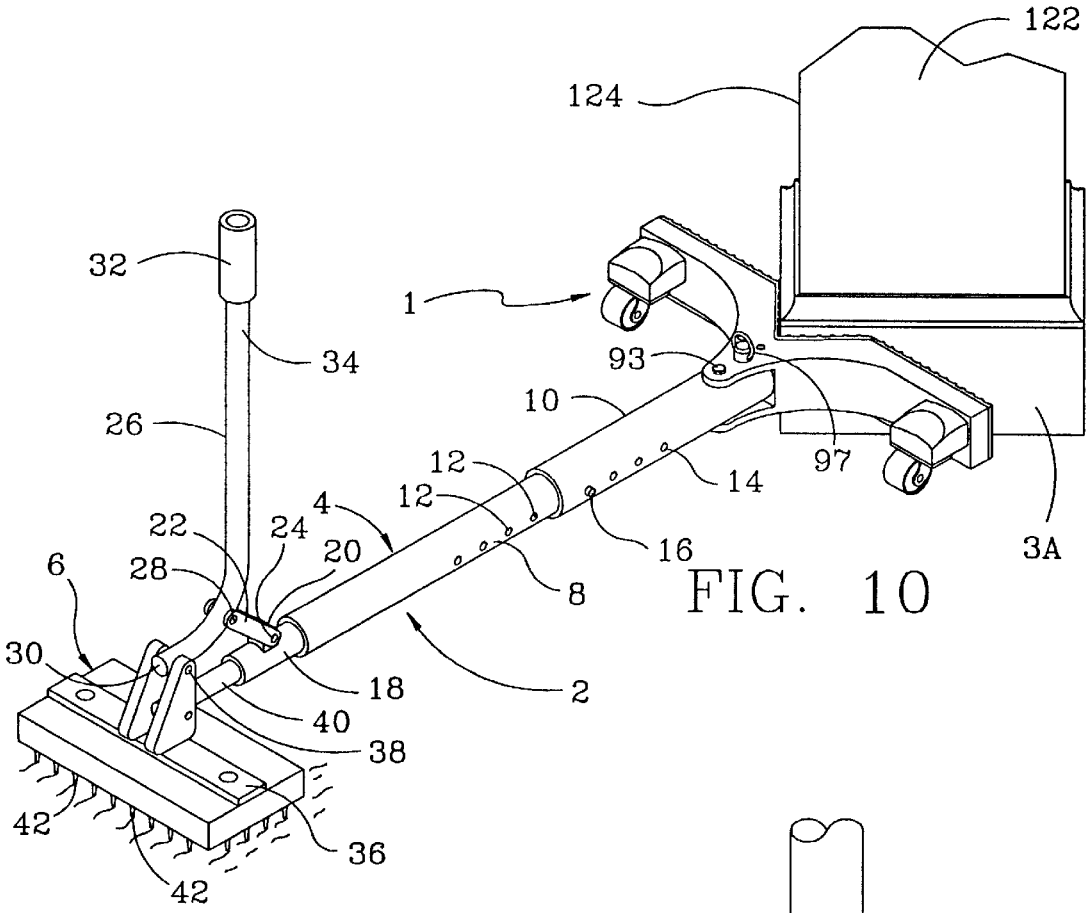
FIG. 10 is a perspective view similar to FIG. 1 showing the tail stock being used to push against intersecting corner wall surfaces.

A second application of tail stock 1 is shown in FIG. 10. Tail stock 1 may be used to push against a pair of intersecting corner surfaces 122. Surfaces 122 form an outwardly extending 90° corner 124 which extends within V-shaped recess 53. Angle "A" of V-shaped section 52 is approximately equal to 90° allowing abutting surfaces 56 and 58 to evenly abut surfaces 122. Ribs 68 of layer 66 contact surfaces 122 and prevent tail stock 1 from slipping out of its juxtaposed engagement with corner 124. V-shaped recess 52 allows tail stock 1 to engage intersecting walls of an L or U-shaped room, a square pillar housing often used to enclose a center post of a large room, a doorway or any other structure formed by two outwardly extending intersecting corner surfaces.

Figure 11:
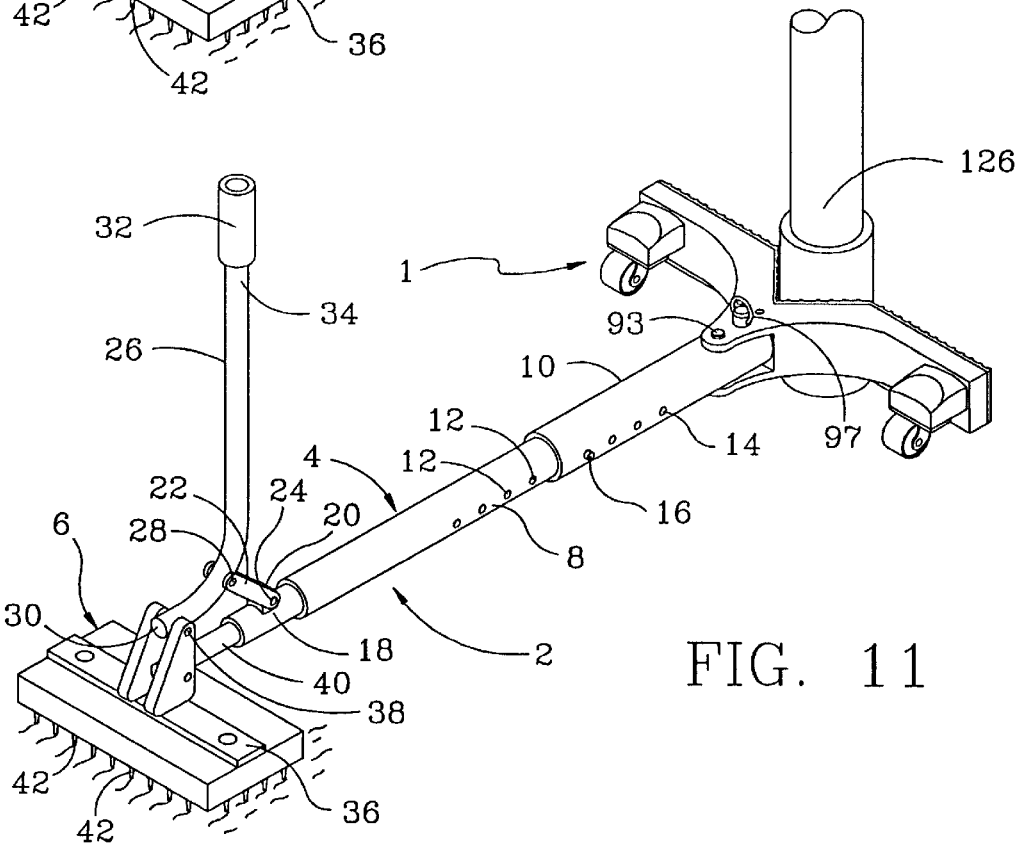
FIG. 11 is a perspective view similar to FIG. 10 showing the tail stock being used to push against a center post.

Tail stock 1 is shown in FIG. 11 in a third application. Tail stock 1 may be used to engage a cylindrical-shaped center post 126. V-shaped recess 52 receives center post 126 allowing abutting surfaces 56 and 58 to engage center post 126 centrally within V-shaped recess 53. The symmetrical shape of tail stock 1 and the alignment of holes 90–96 with the vertex of angle "A", and stabilizing pin 97 allow carpet stretcher 2 to push outwardly against post 126. Ribs 68 of layer 66 grips post 126 and prevent tail stock 1 from slipping or moving from its engagement with post 126.

Figure 12:
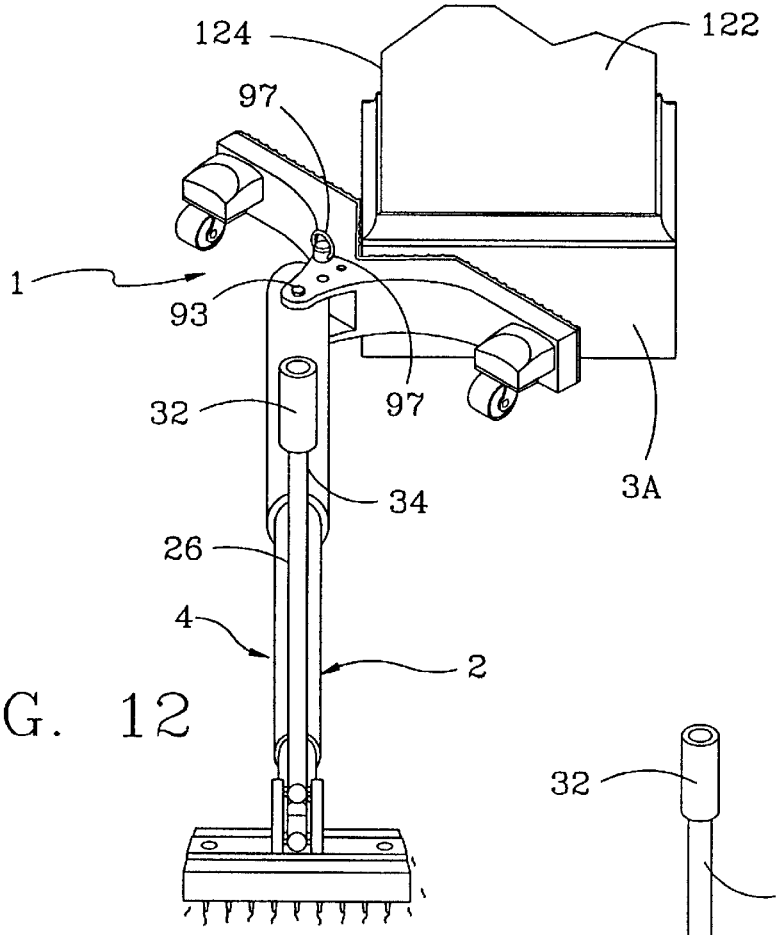
FIG. 12 is a perspective view similar to FIG. 10 showing the tail stock in a pivoted position relative to the carpet-engaging head.

The pivotal engagement between the tail stock end of telescoping section 10 within recessed area 86 between top and bottom flanges 82 and 84, respectively, allows carpet engaging head 6 to stretch the carpet angularly outwardly relative to tail stock I in a fourth application, as shown in FIG. 12. Ribs 68 of layer 66 grip surfaces 122 to prevent tail stock 1 from slipping from its engagement with corner 124, in a similar manner as that shown in FIG. 10 and as described above.

Figure 14:
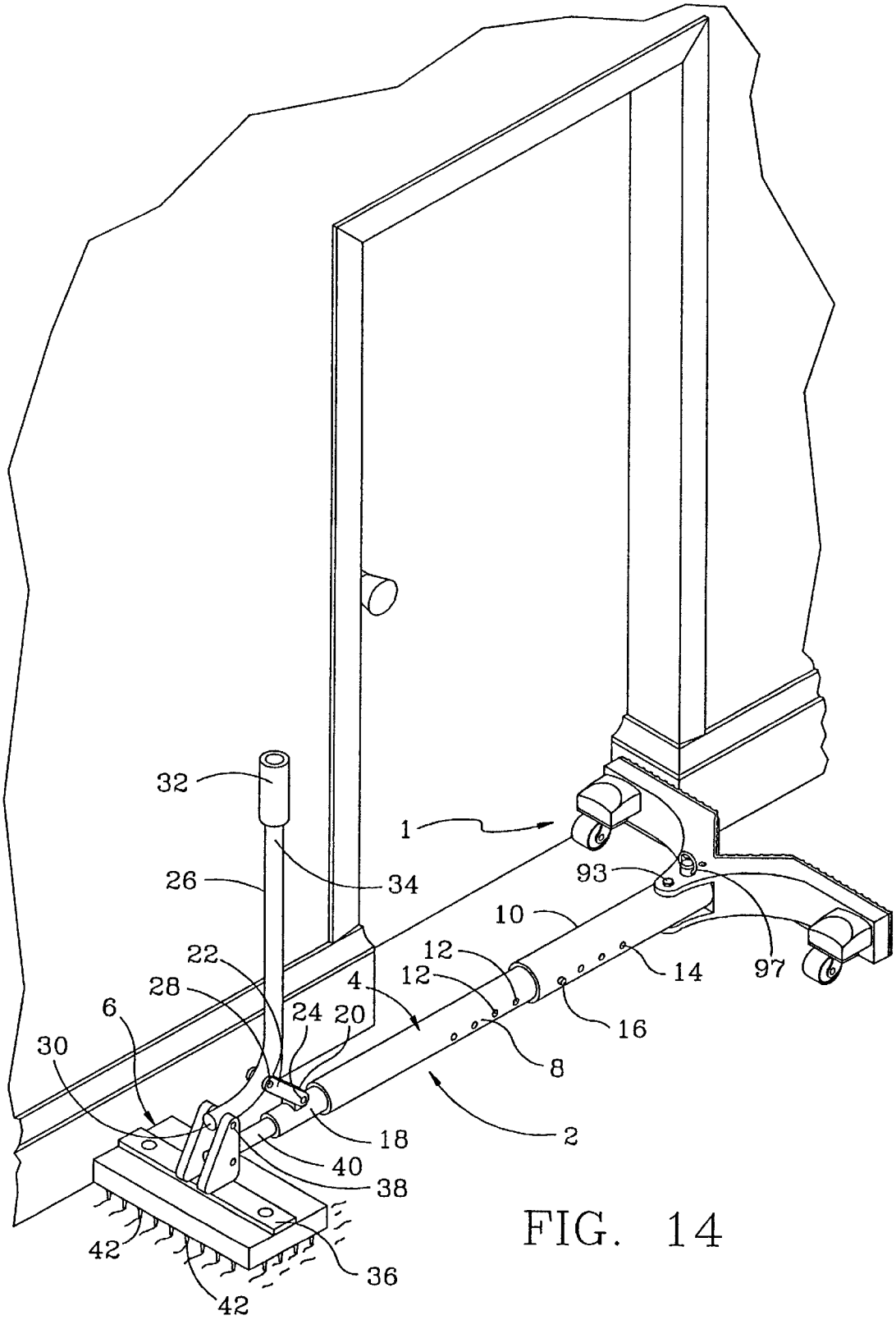
FIG. 14 is a perspective view similar to FIG. 11 showing the tail stock in a rigid configuration being used to push against a doorframe of a hallway.

A fifth application of tail stock I is shown in FIG. 14 with one of coplanar surfaces 60 or 62 being used to push against a door frame or small corner wall such as that found in a hallway. For example, in a long hallway such as that of a hotel, telescoping section 10 is not of sufficient length to extend the entire distance of the hallway. When stabilizing pin 97 is inserted through holes 94 and 96 and telescoping section 10, one of coplanar surfaces 60 or 62 of tail stock 1 may be inserted into a doorway to push against the door frame. This allows the other of coplanar surfaces 60 and 62 to extend outwardly into the hallway and allows telescoping section 10 to extend relatively straight through the hallway.

In accordance with another of the features of the invention, a tail hook attachment, indicated generally at 130 (FIG. 9), is removably attachable to tail stock 1. Floor hook attachment 130 generally includes a V-shaped plate 132 having an included angle "B" substantially equal to included angle "A" of V-shaped section 52. A support block 134 extends within the inside of plate 132 across angle "B". A claw 136 extends outwardly from plate 132 orthogonally to and through block 134. Claw 136 includes an outwardly extending straight section 137 and a downwardly extending pointed end 138. A flange 140 extends outwardly from the top of plate 132 in a direction opposite to that of claw 136. Flange 140 includes a hole (not shown) formed therein which aligns with hole 100 of V-shaped section 50 of tail stock 1 when floor hook attachment 130 is attached thereto. A threaded bolt 142 extends within the hole of flange 140 and hole 100 of tail stock 1 to secure floor hook attachment 130 within V-shaped recess 53. The rear of plate 132 is complementary shaped to abutting surfaces 56 and 58 of V-shaped section 52 allowing floor hook attachment 130 to be placed in juxtaposition with abutting surfaces 56 and 58.

Alternatively, body 50 may be free of threaded hole 100 and flange 140 of floor hook attachment 130 may extend further outwardly allowing the hole formed therein to align with second holes 94 and 96. Stabilizing pin 97 will extend through the hole formed in flange 140, hole 94, the tail stock end of telescoping section 10 and hole 96. Stabilizing pin 97 will both stabilize telescoping section 10 relative to tail stock 1 and rigidly mount tail hook attachment 130 within V-shaped section 152. This alternative configuration of flange 140 allows stabilizing pin 97 to be stored within hole 98 when not in use and to be easily inserted through holes 94 and 96, flange 140 and telescoping section 10. Floor hook attachment 130 is then easily and quickly attached to tail stock I using stabilizing pin 97. Further, this configuration eliminates the need for threaded bolt 142 which may be lost or misplaced when tail hook attachment 130 is not in use.

Figure 13:
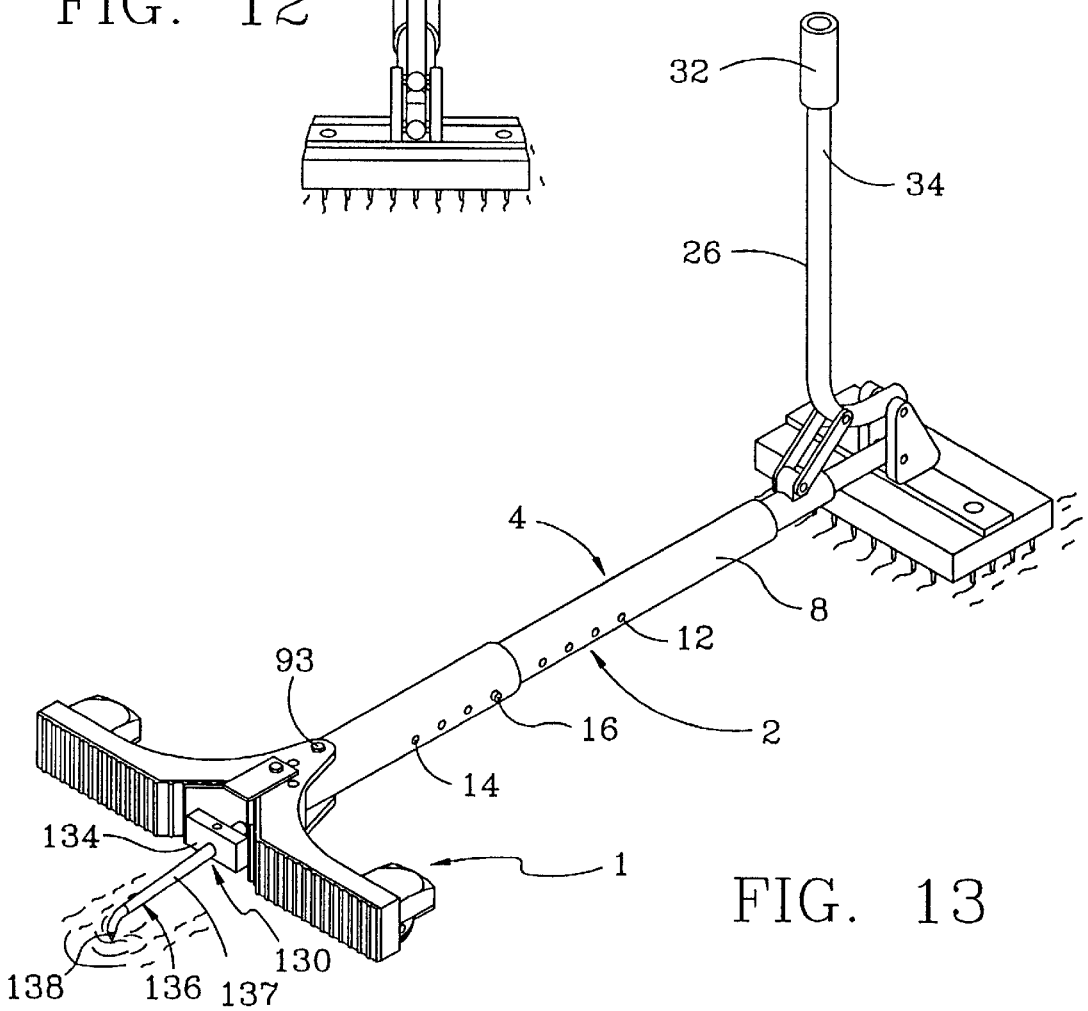
FIG. 13 is a perspective view similar to FIG. 11 showing the floor hook attachment attached to the tail stock to anchor the tail stock directly on the floor.

Floor hook attachment 130 allows carpet stretcher 2 to be used in a sixth application as shown in FIG. 13. Pointed end 138 of claw 136 extends downwardly into the carpet and floor board of the floor upon which the carpet is being installed by the carpet installer. Claw 136 anchors tail stock 1 to the floor and allows carpet engaging head 6 to stretch the carpet outwardly away from tail stock 1. Floor hook attachment 130 may be used, for example, in a large room free of center posts 126.

The versatility of tail stock 1 with floor hook attachment secured thereto, requires only one device to be carried to and from a work place thus decreasing the weight of the equipment needed to install the carpet. Further, tail stock 1 eliminates the need for additional equipment, such as Z-shaped hooks or stretcher hooks commonly used during carpet installation, and decreases the number of trips to and from the installer's work truck when starting and finishing the installation.

Accordingly, co-planar surfaces 60 and 62, abutting surfaces 56 and 58 and layer 66 allow tail stock 1 to engage flat wall 3, corner 124 or post 126. Further, floor hook attachment 130 is secured in juxtaposition with abutting surfaces 56 and 58 to allow tail stock 1 to be used to stretch carpet in a large room free of center posts. Ribs 68 of layer 66 frictionally secure tail stock 1 in position and prevent tail stock 1 from slipping from its engagement with the wall, post or corner engaged thereby. Additionally, flanges 82 and 84 and holes 90–96 formed therein allow tail stock 1 to pivotally mount on the tail stock end of tubular member 4. Also, stabilizing pin 97 rigidly secures tubular member 4 to tail stock 1 preventing the pivotal movement thereof. Furthermore, rotatably mounted wheels 108 allow tail stock 1 to be easily moved along wall 3 or around a center post during carpet installation.

Accordingly, the improved tail stock for a carpet stretcher is simplified, provides an effective, safe, inexpensive, and efficient device which achieves all the enumerated objectives, provides for eliminating difficulties encountered with prior art devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved tail stock for a carpet stretcher is constructed and used, the characteristics of the construction, and the advantageous, new and useful results obtained; the new and useful structures, devices, elements, arrangements, parts and combinations, are set forth in the appended claims.

I claim:

1. A tail stock for a carpet stretcher having a carpet-engaging head and a tubular member, said tail stock including:

a body having a wall engaging surface; and floor hook means detachably connected to the body adjacent the wall engaging surface for hooking the tail stock on a substantially horizontal planar surface, said floor hook means having a first end having an outwardly facing surface which is in face to face contact with the wall engaging surface when the floor hook means is detachably connected to the body.

2. The tail stock defined in claim 1 in which the floor hook means includes a second end having an outwardly extending claw.

3. The tail stock defined in claim 2 in which the first end of the floor hook means is complementary in shape to the wall engaging surface.

4. The tail stock defined in claim 3 in which the wall engaging surface of the body includes a V-shaped middle portion and a pair of co-planar portions extending outwardly from a pair of non-intersecting ends of the V-shaped middle portion.

5. The tail stock defined in claim 4 in which the first end of the floor hook engages the V-shaped middle portion.

6. The tail stock defined in claim 1 further including pivot means for pivotally mounting said tail stock to an end of the tubular member.

7. The tail stock defined in claim 6 in which the pivot means includes a pair of spaced flanges extending outwardly from a rear of the body and adapted to receive the tubular member therebetween, a first pair of axially aligned holes formed in said flanges and a pivot pin extending through the tubular member and said first pair of holes.

8. The tail stock defined in claim 7 further including a removable stabilizing means for stabilizing the tail stock in a rigid configuration and preventing the pivotal movement thereof.

9. The tail stock defined in claim 8 in which the stabilizing means includes a second pair of axially aligned holes formed in the flanges adjacent the first pair of holes and a removable stabilizing pin which extends through the tubular member and the second pair of holes to rigidly attach the tail stock to the end of the tubular member.

10. The tail stock defined in claim 1 further including resilient material mounted on the V-shaped portion and the coplanar portions.

11. The tail stock defined in claim 1 further including a pair of wheels rotatably mounted on the body.

12. A tail stock for a carpet stretcher having a carpet-engaging head and a tubular member, said tail stock including:

a body having a wall engaging surface adapted to engage a wall;

a pair of parallel spaced flanges extending horizontally outwardly from a rear of the body, said flanges being adapted to pivotally mount the tail stock directly to an end of the tubular member by receiving said tubular member therebetween; and floor hook means detachably connected to the body adjacent the wall engaging surface for hooking the tail stock on a substantially planar surface, said floor hook means having a V-shaped plate and a support block connected to said V-shaped plate, said V-shaped plate in face to face contact with said wall engaging surface of said body.

13. The tail stock defined in claim 12 further including a first pair of axially aligned holes formed in the flanges and a pivot pin which extends through the tubular member and through the first pair of holes.

14. The tail stock defined in claim 13 further including floor hook means attachable to the body for securing the tail stock to a substantially horizontal planar surface.

15. The tail stock defined in claim 14 in which the floor hook means includes a first end having an outwardly extending claw.

16. The tail stock defined in claim 15 in which the body includes a V-shaped middle portion and a pair of co-planar portions extending outwardly from a pair of non-intersecting ends of the V-shaped middle portion.

17. The tail stock defined in claim 13 further including a second pair of vertically aligned holes formed in the flanges adjacent to the first pair of holes and a stabilizing pin which extends through the tubular member and the flanges to lock the tail stock in a rigid position relative to the carpet engaging head.

18. The tail stock defined in claim 12 further including a layer of resilient material disposed on the V-shaped middle portion and the coplanar surfaces of the body, said layer of resilient material being formed with a plurality of parallel vertically extending ribs on an outer surface thereof.

19. The tail stock defined in claim 12 further including a pair of wheels rotatably mounted on the body.

20. A tail stock for a carpet stretcher having a carpet-engaging head and a tubular member, said tail stock including:

a body adapted to engage a wall; and stabilizing means for selectively stabilizing the tail stock in a rigid configuration with respect to the tubular member, said stabilizing means including a stabilizing pin which selectively extends directly through the tubular member to selectively connect the tubular member to the tail stock in said rigid configuration; said body further including a pair of parallel-spaced flanges extending horizontal outwardly for pivotally mounting the tail stock directly to an end of the tubular member when said stabilizing pin does not extend through said tubular member, the tubular member being received between said flanges; a first pair of axially aligned holes formed in the flanges and a pivot pin which extends through the tubular member and through the first pair of holes; and a second pair of axially aligned holes formed in the flanges adjacent to the first pair of holes for selectively receiving the stabilizing pin.

* * * * *